US007118094B2

(12) United States Patent
McDaniel et al.

(10) Patent No.: US 7,118,094 B2
(45) Date of Patent: Oct. 10, 2006

(54) ROTATABLE CABLE GUIDE WITH CABLE SWITCHING FEATURE

(75) Inventors: Miriam H. McDaniel, Palmdale, CA (US); Geoffrey D. Simpson, Palmdale, CA (US)

(73) Assignee: Space-Age Control, Inc., Palmdale, CA (US)

( * ) Notice: Subject to any disclaimer, the term of this patent is extended or adjusted under 35 U.S.C. 154(b) by 340 days.

(21) Appl. No.: 10/851,277

(22) Filed: May 21, 2004

(65) Prior Publication Data

US 2005/0258302 A1 Nov. 24, 2005

(51) Int. Cl.
*B66D 1/36* (2006.01)

(52) U.S. Cl. ..... 254/335; 254/394

(58) Field of Classification Search ..... 254/335–338, 254/393–395

See application file for complete search history.

(56) References Cited

U.S. PATENT DOCUMENTS

| | | | | |
|---|---|---|---|---|
| 80,276 | A | 7/1868 | Dable | |
| 522,524 | A | 7/1894 | Hook | |
| 901,794 | A | 10/1908 | Elzy | |
| 1,433,751 | A | 10/1922 | Stahl | |
| 1,537,545 | A | 5/1925 | Morton | |
| 1,589,776 | A | 6/1926 | Warden | |
| 1,805,800 | A * | 5/1931 | Berger | 254/395 |
| 1,820,495 | A | 8/1931 | Richardson | |
| 2,106,000 | A | 1/1938 | George | |
| 2,168,463 | A | 8/1939 | Wunsch | |
| 2,362,531 | A | 11/1944 | Berger | |
| 2,458,573 | A | 1/1949 | Donahue | |
| 2,650,066 | A | 8/1953 | Troyer | |
| 2,738,938 | A | 3/1956 | Benson | |
| 2,819,789 | A * | 1/1958 | Lang | 226/183 |
| 3,174,726 | A | 3/1965 | Atkinson et al. | |
| 3,618,899 | A | 11/1971 | Hancock, Jr. | |
| 4,285,501 | A | 8/1981 | Schneider | |
| 4,337,553 | A | 7/1982 | Fischer | |
| 4,511,122 | A | 4/1985 | Svendsen | |
| 4,669,145 | A | 6/1987 | Kehr | |
| 5,573,226 | A | 11/1996 | Smith | |
| 5,927,693 | A * | 7/1999 | Hackl | 254/398 |
| 6,471,191 | B1 | 10/2002 | Rotzler | |
| 6,712,338 | B1 * | 3/2004 | Schafer | 254/335 |
| 6,926,259 | B1 * | 8/2005 | Roodenburg et al. | 254/277 |
| 6,983,927 | B1 * | 1/2006 | Pelletier et al. | 254/385 |

* cited by examiner

*Primary Examiner*—Emmanuel M Marcelo
(74) *Attorney, Agent, or Firm*—John V. Stewart

(57) ABSTRACT

A cage in which two pulley wheels are mounted with tangent circumferences so that their circumferential cable grooves surround a cable passing between the wheels. The cage freely rotates about an axis that passes between the wheels. The cage axis is normal to the plane of the parallel wheel axes. The cage extends forward of the wheels and forms two curved edges on opposed sides of the cage axis. Each curve has an apex at its forward-most point. A flexible cable passes through the cage, between the wheels, and forward between the curves. Extending the cable substantially away from the plane of the wheels causes it to contact one of the curves. This rotates the cage so that the wheels are aligned with the cable deflection. This switches the cable to one or the other of the wheels, and provides low friction cable operation for any cable direction.

14 Claims, 3 Drawing Sheets

ROTATABLE CABLE GUIDE WITH CABLE SWITCHING FEATURE

BACKGROUND OF THE INVENTION

1. Field of the Invention

This invention relates to devices for guiding and redirecting a flexible cable extending from a spool.

2. Description of Prior Art

Numerous cable guide designs are found in the prior art for sailboat rigging, excavating machines, cranes, winches, and other diverse applications for flexible cables. These guides include types for keeping a cable extending in a generally constant direction from a cable winding spool while allowing redirection of the cable to various angles beyond the cable guide. Some guides only allow redirection within a plane, and some of these are limited to about a 90-degree range of angles. Some guides provide a large range of angles in a plane by means of two adjacent pulley wheels. Others improve further on this by providing a swivel mount for the two pulley wheels, so the cable can be redirected in any plane. The two most relevant examples found are described below.

U.S. Pat. No. 1,433,751 (Stahl Oct. 31, 1922) Swivel Fair Lead

U.S. Pat. No. 3,174,726 (Atkinson et al. Mar. 23, 1965) Fairlead

Stahl and Atkinson provide two circumferentially adjacent pulley wheels mounted in a swiveling frame. They also provide two parallel rollers on the frame. The wheels have parallel axes in a first plane normal to the swivel axis. The rollers have parallel axes in a second plane normal to the swivel axis. The roller axes are 90 degrees offset from the wheel axes about the swivel axis. A cable extending tangentially from a winding spool passes between the two pulley wheels, then between the two rollers, after which it can be redirected to any angle without changing its angle from the winding spool. The rollers add the capability of low-friction redirection outside the plane of the wheels.

The present invention provides the same advantages, but eliminates the rollers by providing a unique and non-obvious pair of opposed curved edges, making the present guide much simpler and less expensive. None of the prior devices have the same degree of both flexibility and simplicity as the present invention.

SUMMARY OF THE INVENTION

The main objective of the invention is provision of a reliable, low-friction cable guide that holds a flexible cable in a generally constant direction of extension from a cable winding spool, and allows the cable to extend from the guide with low friction in wide range of directions. Additional objectives include:

1. Simplicity and low cost,
2. Compactness,
3. Quick and easy assembly with minimal tooling,
4. Scalable for small or large diameter cable,
5. Rotating components can be electronically instrumented to provide relative position information in order to use the cable to measure distances from the spool,
6. Elimination of gimballed or otherwise flexible 2D or 3D mounting bases for the cable spool.

These objectives are met in a cable guide with a rotatable cage in which two pulley wheels are mounted with their circumferences tangent so that their cable grooves surround a cable passing between the wheels. The cage freely rotates about an axis that passes between the wheels. The cage axis is normal to the plane of the wheel axes. The cage extends forward of the wheels and forms two curved edges on opposed sides of the cage axis. Each curved edge has an apex at its forward-most point. A flexible cable can pass through the cage, between the wheels, and forward between the curves. Any deflection of the cable from the plane of the wheels causes the cage to rotate until the wheels are aligned with the cable. If the cable is extended in a direction such that it contacts one of the curved surfaces, it will slide away from the curve apex, and create a force against the curved edge that rotates the cage until the wheels are aligned with the cable. This switches the cable to properly ride on one or the other of the wheels, thus providing low friction cable operation for any cable direction.

REFERENCE NUMBERS

Figure 1:
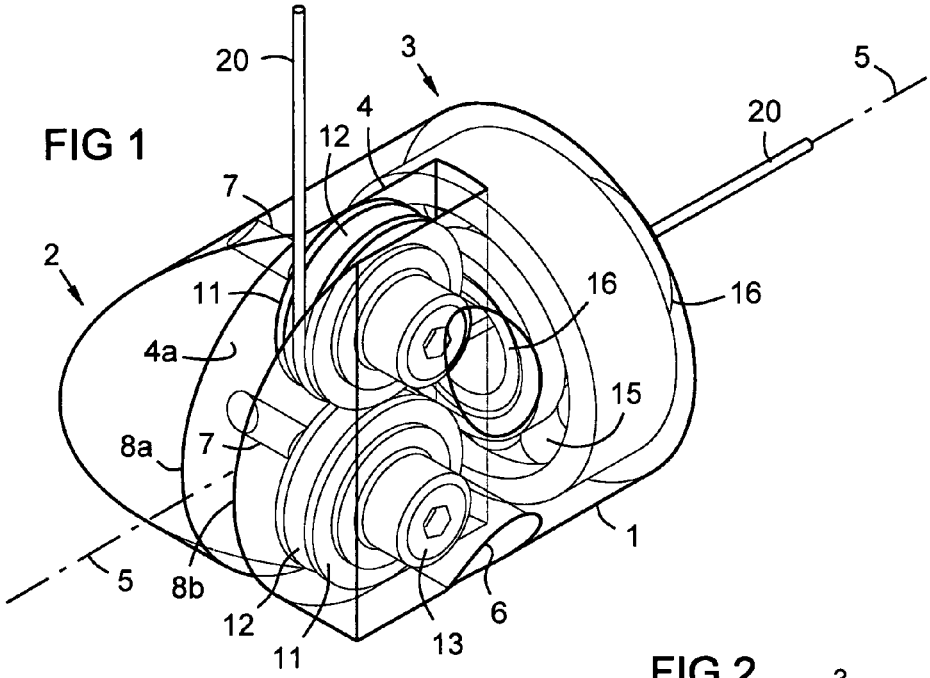
FIG. 1 is a front right upper transparent perspective view of the invention.

1. Rotatable cage
2. Front end of cage
3. Back end of cage
4. Slot
4*a*. First opposed side surface of slot
4*b*. Second opposed side surface of slot
5. Cage rotation axis
6. Access hole for pulley wheel axle bolt
7. Threaded hole for pulley wheel axle bolt
8*a*. Apex on first cable switching edge or curve
8*b*. Apex on second cable switching edge or curve
11. Pulley wheel
12. Circumferential groove in pulley wheel
13. Pulley wheel axle bolt
15. Cage rotation bearing
16. Cage mounting axle
17. Cable passage or channel through cage
20. Flexible cable
21. Cable winding spool or drum
22. Cable spool frame mounting plate

23. Frame containing winding spool
AA. Cable redirection or deflection angle

DETAILED DESCRIPTION

The invention is a cable guide for flexible cable or cord of any type extending from a winding spool. The guide holds the cable in a generally constant direction from the spool, and redirects the cable to/from any angle of use without binding or rubbing.

Figure 2:
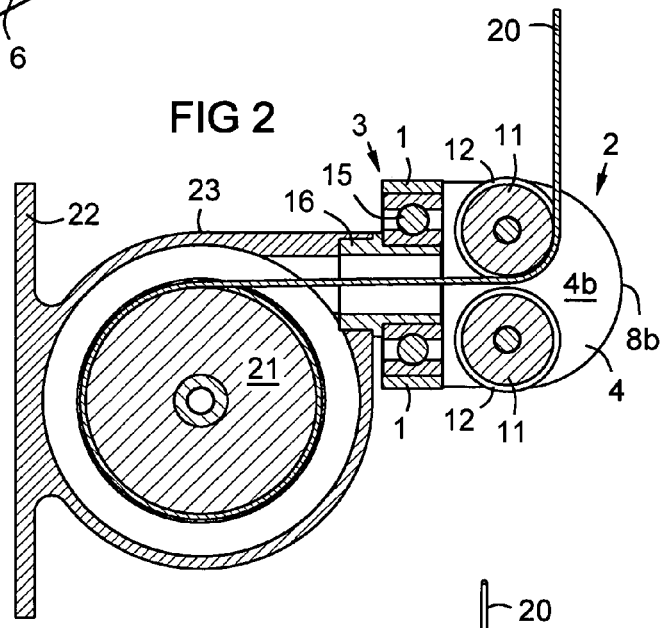
FIG. 2 is a left side sectional view of the invention and an attached cable spool, taken along a vertical plane through the cage rotation axis.
Figure 3:
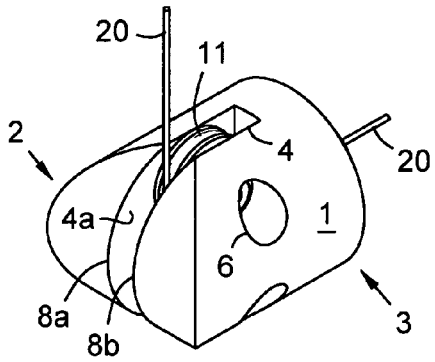
FIG. 3 is a front right upper perspective view of the invention.
Figure 4:
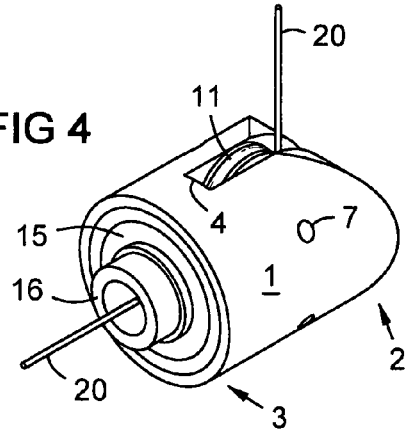
FIG. 4 is a back left upper perspective view of the invention.
Figure 5:
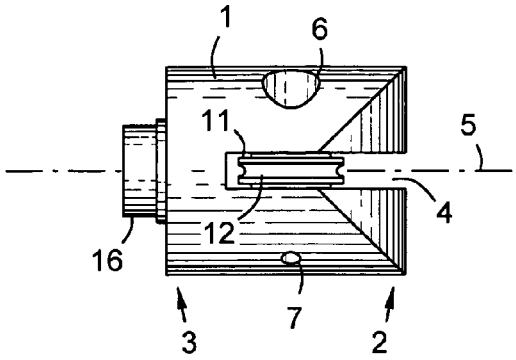
FIG. 5 is a top view of the invention. The bottom view is a mirror image.
Figure 6:
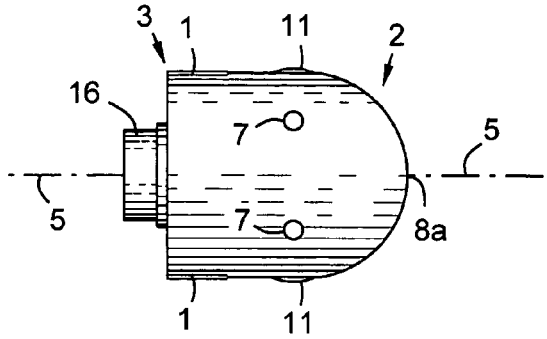
FIG. 6 is a left side view of the invention.
Figure 7:
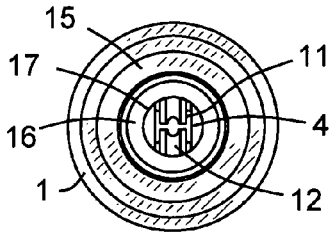
FIG. 7 is a back view of the invention.
Figure 8:
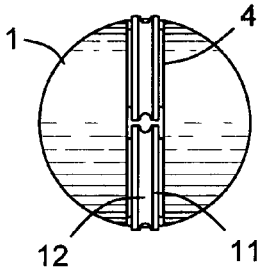
FIG. 8 is a front view of the invention.
Figure 9:
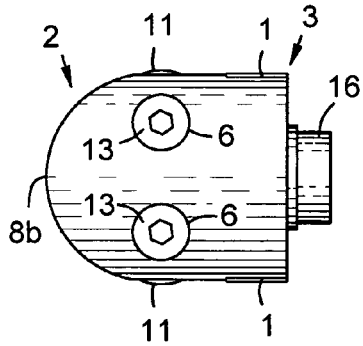
FIG. 9 is a right side view of the invention.

FIG. 1 shows a rotatable cage 1 in which two pulley wheels 11 are mounted with their circumferences tangent to each other so that their cable grooves 12 surround a cable 20 passing between the wheels. The cage freely rotates on bearings 15 about an axis 5 that passes between the wheels. The wheels are preferably the same size, and their axes are both in substantially the same plane, which is substantially normal to the cage axis. The bearings 15 are preferably sealed ball bearings as shown, and are behind the wheels. FIG. 2 shows a hollow mounting axle 16 that mounts the cage on a frame 23 containing a cable winding spool 21.

The wheels are mounted in a slot 4 in the cage that divides the front end 2 of the cage, and is preferably open at the sides of the cage. The wheels preferably extend laterally outside the cage so the cable can be redirected around either wheel up to at least 170 degrees from the forward extension of the cage axis without contacting the cage. This range per wheel provides a total range of redirection of up to at least 340 degrees from one extreme to the other. The terminology "up to at least" means at least the given range is preferably offered in the product, and the cable can be redirected up to the given limit or less as needed.

In addition to redirection away from the forward extension of the cage axis over the pulley wheels, the cable can also be moved to any angle of rotation about the cage axis. This is made possible by rotation of the cage, which automatically aligns the wheels with the angle of the cable. The cage front extends forward of the wheels and forms two curved edges 8*a* and 8*b* where the front surface of the cage intersects the opposed side surfaces 4*a* and 4*b* of the slot 4. These curved edges lie on opposite sides of the cage axis. Each curve has an apex at its forward-most point, which is the central point on the curve, and is the point on the curve nearest the cage axis.

The curved edges 8*a* and 8*b* cause the cage to rotate into wheel alignment with the cable. The cable passes through the cage, between the wheels, and forward between the curves. If the forward extension of the cable is pulled away from the cage axis in the plane of the wheels, the cable rides on one of the wheels and is smoothly guided in the desired direction. If the forward extension of the cable is pulled in a direction such that it contacts one of the curved edges 8*a* or 8*b* of the cage, this contact generates a rotational force on the cage, causing it to rotate into wheel alignment with the angle of the cable. If the cable is extended in a direction normal to the wheels, and midway between them, the cable contacts one of the curved edges at its apex. This causes the cable to slip to one side or the other of the apex, switching it to a respective one or the other of the wheels for low friction operation.

Figure 10:
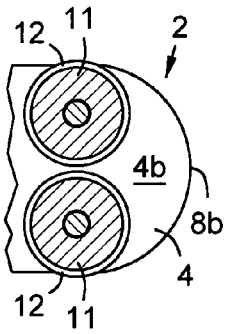
FIG. 10 is a left partial sectional view of the invention showing a semicircular cable switching curve.
Figure 11:
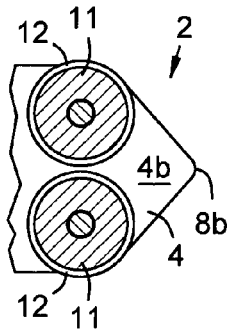
FIG. 11 is a left partial sectional view of the invention showing a cable switching curve formed from two straight lines meeting at a rounded apex.
Figure 12:
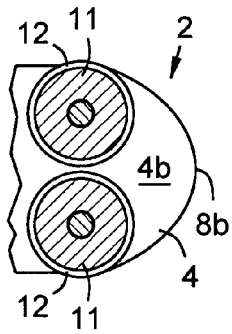
FIG. 12 is a left partial sectional view of the invention showing an elliptical cable switching curve.
Figure 13:
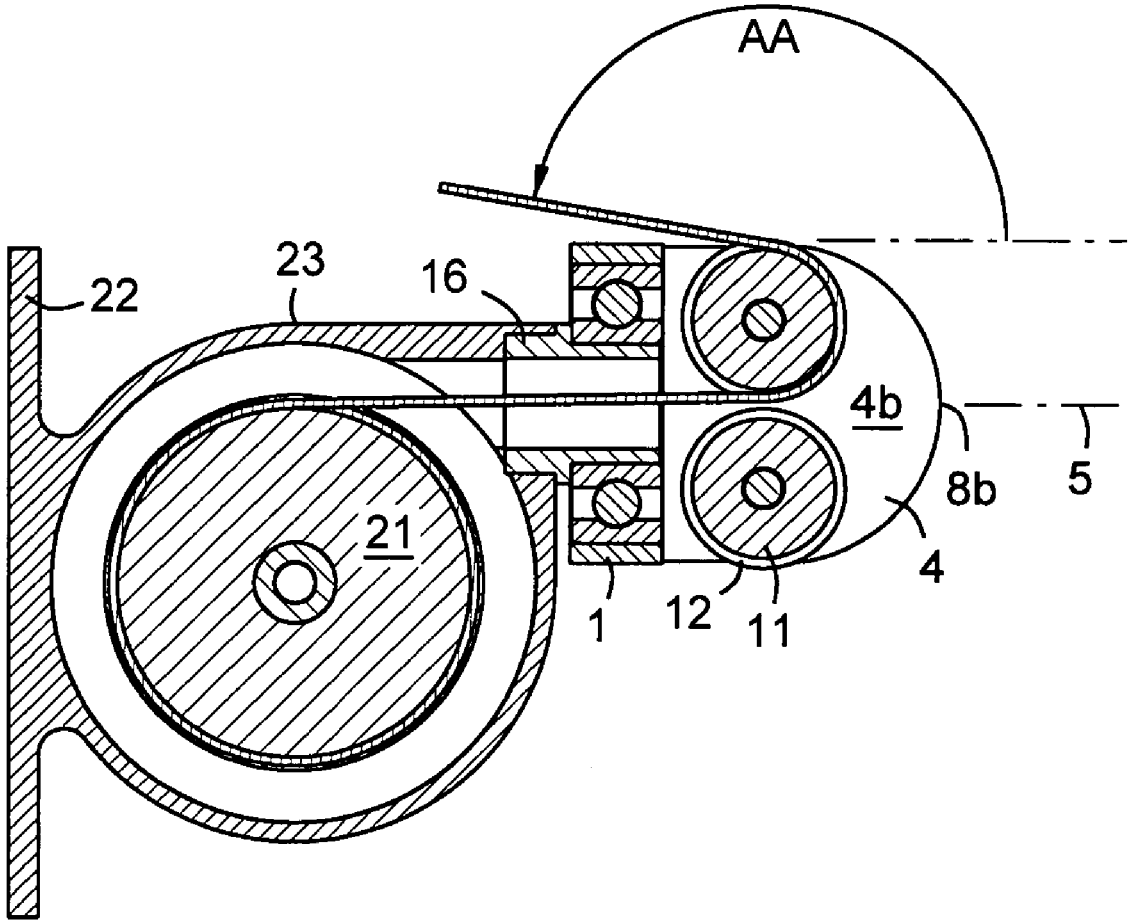
FIG. 13 is a left side sectional view of the invention and an attached cable spool, taken along a vertical plane through the cage rotation axis, showing a maximal cable deflection angle.

Examples of appropriate shapes for the cable switching curves are shown in FIGS. 10–12. Any plane curve with a single central rounded apex can be used. These include conic section curves of types that have an apex. They also include circular arcs, in which case the forwardmost point is designated as the apex of the curve. Parts of circular, elliptical, hyperbolic, or parabolic curves can be used, as well as two straight lines meeting at a curved apex as in FIG. 11. In addition 3-dimensional curves can be used that have a central apex near the cage axis. For example, 'lips' that radially approach the cage axis at the curve apex can be used.

The material of the curved edges is preferably a durable low friction material. For small cable under light loads, plastics such as Delrin or Nylon can be used. The whole cage is preferably made of the same material for simplicity of production. However, the curved edges can optionally have 'lips' of a desired low-friction material on a different case material.

The invention was developed with small cable-type displacement sensors in mind. However, it has broad applicability for many types of extendable cable and line uses, such as in winches, clotheslines, cranes, excavating machines, and sailboat rigging.

For use in a displacement sensor, the extension of the cable is measured by a sensor on or near the cable spool. For example, an inductive transducer can be connected to the cable spool axle to provide an electrical signal representing the rotational position of the spool. This signal can be converted to the linear extension of the cable, allowing the cable to be used as a measuring device in any direction from the spool.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

We claim:

1. A cable guide, comprising:

a rotatable cage having front and back ends, a rotation axis passing through the front and back ends of the cage, and a cable channel along the cage rotation axis;

a slot dividing the front of the cage, the slot having first and second opposed side surfaces;

two pulley wheels rotatably mounted in the slot on opposite sides of the cage axis, each wheel having a rotation axis, the wheel axes substantially parallel to each other defining a plane normal to the cage axis, each wheel having a circumference and a continuous circumferential groove, the wheels being mounted adjacent to each other with approximately mutually tangent circumferences; and the front end of the cage extending forward of the wheels, and forming a respective first and second curved edge with each respective side surface of the slot, each curved edge having an apex that is the forward-most point on the edge and also the point on the edge that is nearest the cage axis;

whereby a cable can pass through the cage, between the two wheels, and a deviation of the cable forward of the wheels that is sufficient to contact either of the curved edges tends to rotate the cage, causing the wheels to align with the plane of the deviation, and causing the cable to fall into the respective groove in one or the other of the wheels.

2. The cable guide of claim 1, wherein each pulley wheel extends laterally outside the cage sufficiently that a flexible cable passing forward through the cable passage can be redirected up to at least 170 degrees around either of the pulley wheels without interference from the case.

3. The cable guide of claim 1, wherein both pulley wheels have approximately the same diameter, and the apexes of the curved edges are within a range of distances of 0.7 to 1.4 wheel diameters forward of the pulley wheel axes.

4. The cable guide of claim 3, wherein each of the curved edges follows a conic section curve of a type having a vertex, the vertex of the conic section curve forming the apex of the curved edge.

5. The cable guide of claim 3, wherein each of the curved edges follows part of a plane curve selected from the set consisting of: a circle, a parabola, a hyperbola, an ellipse, and two generally straight lines meeting and rounded at the apex.

6. A cable guide comprising:

a rotatable cage having a front end, a back end, a rotation axis passing through the front and back ends of the cage, a cable passage along the cage rotation axis that is open to the front and back ends of the cage;

a slot in the cage passing transversely across the cage axis, open on the front of the cage, open on opposite sides of the cage, and having first and second opposed side surfaces;

first and second pulley wheels, each wheel having an axis and a continuous circumferential groove for a cable, the two wheels rotatably mounted in the slot on opposite sides of the cage axis with approximately tangent circumferences, aligned grooves, and substantially parallel axes;

the cage front extending forward of the pulley wheels; and the cage front intersecting the first and second side surfaces of the slot to form respective first and second cable switching curves;

each of the cable switching curves having an apex at the forward-most point on the curve;

whereby a cable can pass axially through the cage between the two wheels, and a deviation of the cable forward of the wheels that is sufficient to contact either of the switching curves tends to rotate the cage, causing the slot to align with the plane of the deviation, and causing the cable to ride in the groove in one or the other of the wheels.

7. The cable guide of claim 6, wherein each pulley wheel extends laterally outside the cage sufficiently that a flexible cable passing forward through the cable passage can be redirected up to at least 170 degrees around either of the pulley wheels without interference from the case.

8. The cable guide of claim 6, wherein both pulley wheels have approximately the same diameter, and the apexes of the cable switching curves are within a range of distances of 0.7 to 1.4 wheel diameters forward of the wheel axes.

9. The cable guide of claim 8, wherein each of the cable switching curves follows a conic section curve of a type having a vertex, the vertex of the conic section curve forming the apex of the curved edge.

10. The cable guide of claim 8, wherein each of the cable switching curves is part of a plane curve selected from the set consisting of: a circle, a parabola, a hyperbola, an ellipse, and two generally straight lines meeting and rounded at the apex.

11. A cable guide comprising:

a rotatable cage with generally cylindrical sides, a front surface, a back surface, a rotation axis substantially coincident with the geometric axis of the cylindrical sides, and a cable passage through the case around the cage rotation axis;

a slot crossing and dividing the front surface of the cage, open on opposite sides of the cage, the slot having first and second opposed side surfaces;

first and second pulley wheels rotatably mounted in the slot on opposite sides of the cage rotation axis, each wheel having a rotation axis and a circumferential groove, the two wheel axes substantially parallel to each other in a plane substantially normal to the cage rotation axis, both wheels having substantially the same diameter;

the front surface of the cage intersecting the side surfaces of the slot along respective first and second curved edges;

each curved edge having an apex at the forwardmost point on the edge, the apex being within a range of 0.7 to 1.4 wheel diameters forward of the plane of the wheel axes, each curved edge sloping backward and outward in two directions from the apex, and each pulley wheel extending laterally outside the cage sufficiently that a flexible cable passing forward through the cable passage can be redirected up to at least 170 degrees around either of the pulley wheels without interference from the case;

whereby a cable can pass axially through the cage between the two wheels, and a deviation of the cable forward of the wheels that is sufficient to contact either of the curved edges tends to rotate the cage, causing the slot to align with the plane of the deviation, and causing the cable to fall into the groove in one or the other of the wheels.

12. The cable guide of claim 11, wherein each of the curved edges follows a conic section curve of a type having a vertex, the vertex of the conic section curve forming the apex of the curved edge.

13. The cable guide of claim 11, wherein each of the curved edges follows part of a plane curve selected from the set consisting of: a circle, a parabola, a hyperbola, an ellipse, and two generally straight lines meeting and rounded at the apex.

14. The cable guide of claim 11, wherein each of the curved edges follows a part of an ellipse with the major axis of the ellipse parallel to the rotation axis of the cage and a vertex of the ellipse being the apex of the curved edge.

* * * * *